US006105323A

United States Patent [19]

Paulle

[11] Patent Number: 6,105,323

[45] Date of Patent: Aug. 22, 2000

[54] WALL DRAINAGE ASSEMBLY

[75] Inventor: Stephen Paulle, O'Connor, Australia

[73] Assignee: Watertight Products (Aust) Pty. Ltd., O'Connor, Australia

[21] Appl. No.: 09/081,391

[22] Filed: May 18, 1998

[30] Foreign Application Priority Data

May 20, 1997 [AU] Australia ..... PO6911
Sep. 11, 1997 [AU] Australia ..... PO9123

[51] Int. Cl.[7] ..... E04B 1/70

[52] U.S. Cl. ..... 52/302.1; 52/61; 52/62; 52/302.3; 52/302.6; 52/562

[58] Field of Search ..... 52/61, 62, 97, 52/101, 302.1, 302.3, 302.6, 396.04, 396.08, 562, 731.7, 737.6

[56] References Cited

U.S. PATENT DOCUMENTS

| | | | |
|---|---|---|---|
| 2,242,266 | 5/1941 | Scales | 52/101 |
| 2,645,824 | 7/1953 | Titsworth | 52/302.3 |
| 2,703,002 | 3/1955 | Suskind | 52/302.3 |
| 2,934,931 | 5/1960 | Johnson . | |
| 3,293,810 | 12/1966 | Cox et al. . | |
| 3,429,084 | 2/1969 | Brewer | 52/101 |
| 3,922,826 | 12/1975 | Molyneux | 52/62 X |
| 4,528,784 | 7/1985 | Simpson et al. | 52/97 X |
| 5,274,968 | 1/1994 | Pardo | 52/97 |
| 5,349,792 | 9/1994 | Bayes | 52/61 X |
| 5,365,713 | 11/1994 | Nicholas et al. | 52/396.04 X |
| 5,511,351 | 4/1996 | Moore | 52/302.1 |
| 5,765,332 | 6/1998 | Landin et al. | 52/396.04 X |
| 5,870,864 | 2/1999 | Snyder et al. | 52/302.1 X |

FOREIGN PATENT DOCUMENTS

| | | |
|---|---|---|
| 2 547 608 | 12/1984 | France . |
| 1 566 196 | 4/1980 | United Kingdom . |
| 2 193 516 | 2/1988 | United Kingdom . |

*Primary Examiner*—Beth A. Stephan
*Assistant Examiner*—Brian E. Glessner
*Attorney, Agent, or Firm*—Ladas & Parry

[57] ABSTRACT

A drainage arrangement in a dual wall including two leaves separated by a cavity. In one aspect the drainage arrangement includes one or more imperforate elongate members which are formed as a channel, the sides of which are adapted to be mounted to the opposed faces of the leaves of the wall. The one or more elongate members extend for the length of the cavity between the leaves to close the space therebetween and the channel opening into an outlet provided in the wall to allow the drainage of water from the elongate member through the outlet.

25 Claims, 5 Drawing Sheets

WALL DRAINAGE ASSEMBLY

FIELD OF THE INVENTION

This invention relates to a drainage assembly which can be used as a cavity drainage system in the walls of buildings having two leaves which define a cavity between them. In addition the drainage assembly of the invention can be used to prevent the passage of insects, such as termites, past the assembly and into the main structure of the building.

Throughout the specification and claims the term "dual wall" shall be taken as referring to a wall of a building which comprises two leaves separated by a cavity. The leaves may be formed of brick or may comprise a framed structure or a combination of such.

BACKGROUND

In many buildings the external walls of buildings are formed of two leaves which are separated by a cavity. In providing such a wall, consideration must be given to the potential accumulation of water in the base of the cavity which may occur during the construction of the building and in particular before a roof is in place and subsequent to the completion of the building as a result of leakage in the roof, or leakage around windows, or overflowing gutters. The effect of such accumulation results in moisture seeping through the exterior and interior leaves of the wall which will result in deterioration of the wall and wall coverings or paint plaster or stucco applied to the wall. In addition seepage through the interior leaf will result in damage to the contents of the building such as the floor coverings.

In an effort to overcome the problem of the accumulation of water in the base of the cavity of a double leaf wall it has been conventional practice to provide a number of "weep" holes at spaced intervals around the base of the outer leaf of the wall. In the case of double brick walls or brick veneer walls these weep holes are usually provided in some of the vertical joints between adjacent bricks of the lowermost course of the outer leaf of the wall.

The problem that arises with this conventional practice is that during the erection of the wall, material such as excess mortar, sand and miscellaneous building debris generated during the building process accumulates in the base of the cavity. In addition on completion of the building other material will accumulate in the cavity over time. Such material can block the "weep" holes which then severely restricts and/or prevents the drainage of water from the cavity. In addition, the debris provides an absorption medium which will retain the moisture within the cavity rather than allowing it to drain from the cavity. In either case, the accumulation and retention of water in the cavity can lead to the decay and deterioration of the two leaves of the wall and any coatings provided on the outer faces of each leaf. In addition such accumulation can result in the entry of water into the building through the internal leaf of the wall which can ultimately lead to mould forming through the plaster and paintwork of a wall as well as the building contents.

It is an object of this invention to provide a drainage means for use in the cavities of building walls.

DISCLOSURE OF THE INVENTION

Accordingly, the invention resides in a drainage arrangement in the cavity of a dual building wall comprising two leaves separated by a cavity, said drainage arrangement comprising one or more elongate members which are formed as a channel the sides of which are adapted to be mounted to the opposed faces of the leaves of the wall, said elongate members extending for the length of the cavity between the leaves to close the space therebetween, said channel opening into an outlet provided in the wall to allow the drainage of water from the elongate member.

Accordingly the invention also resides in a drainage assembly for use in the cavity of a dual wall, said drainage assembly comprising an elongate member having a central portion formed as a channel, the width of the channel being such that the channel can be received between the leaves of the dual wall, the upper edges of the flanges of the channel each being provided with a laterally extending lip which is intended to be fixed to the respective leaf of said wall whereby the elongate member will extend for the length of the cavity between the leaves, the elongate member having an outlet adapted to extend to the exterior face of the wall to allow the drainage of water from the channel.

According to a preferred feature the wall comprises a double brick wall. According to one embodiment the lips are adapted to be accommodated in a mortar course of the respective leaf of the double brick wall.

According to a preferred feature of the invention the sides of the elongate members are secured between adjacent leaves of the wall. According to one embodiment the elongate members are adapted for use between the leaves of a masonry wall. According to another embodiment the elongate members are adapted for use between the leaves of brick veneer wall. According to a further embodiment the elongate members are adapted for use between the leaves of a wall formed from two framed leaves.

According to a preferred feature of the invention the elongate members comprise a single element cut to the desired length. According to an alternative preferred feature of the invention the elongate members comprise a plurality of elements joined end to end to extend for the length of a wall.

According to a preferred feature of the invention the outlet comprises an end of the elongate member being adapted to be received in an end wall of said dual wall.

According to a preferred feature of the invention the adjacent elongate members provided in connecting walls are interconnected by corner elements which close the spaces between the internal faces of the leaves and the elongate elements at the interconnection and which provide a continuation of the channel of the adjacent elongate members.

According to a preferred feature of the invention the elongate members are located at the base of the wall. According to one embodiment a second set of elongate members are located at or adjacent the upper edge of the wall to prevent access between the space above the second set of elongate members and the space below the second set of elongate members. According to an alternative preferred feature of the invention the elongate members are located at or adjacent the upper edge of the wall.

According to a preferred feature of the invention, the elongate members are formed of a plastics material. According to an alternative preferred feature of the invention, the elongate members are formed of sheet metal.

Accordingly the invention also resides in an insect barrier for buildings comprising a drainage arrangement and drainage assembly as described above located at the base of the wall and wherein the outlet is closed by a perforate element, or mesh or grate which is adapted to prevent the entry of insects past the outlet and into the cavity.

According to a preferred feature of the invention the perforate element comprises an end cap which is applied over the outlet.

Accordingly the invention also resides in an elongate element for use in a drainage arrangement and drainage assembly as described above having a central portion formed as a channel, the width of the channel being such that the channel can be received in the cavity of a dual leaved wall, the upper edges of the flanges of the channel each being provided with a laterally extending lip which is intended to be fixed to the adjacent leaf of the wall.

According to a preferred feature of the invention at least one lip of the elongate elements adapted to be received in a mortar course of a leaf formed of bricks.

According to a preferred feature of the invention at least one lip is formed at its outer edge with a second flange adapted to be fixed to the adjacent leaf by fixings.

The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENTS

Figure 1:
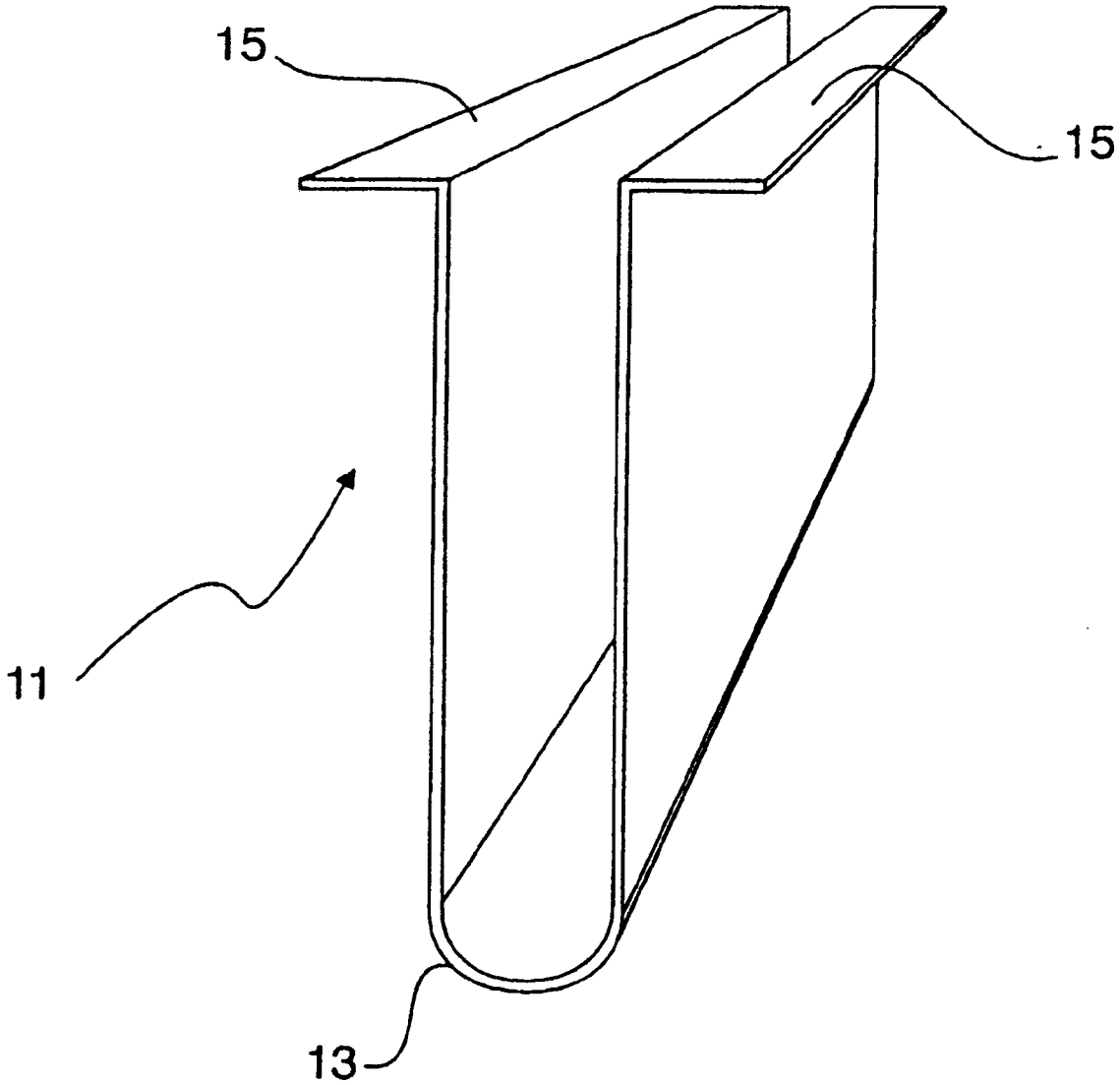
FIG. 1 is an isometric view of a elongate member according to the embodiment.
Figure 2:
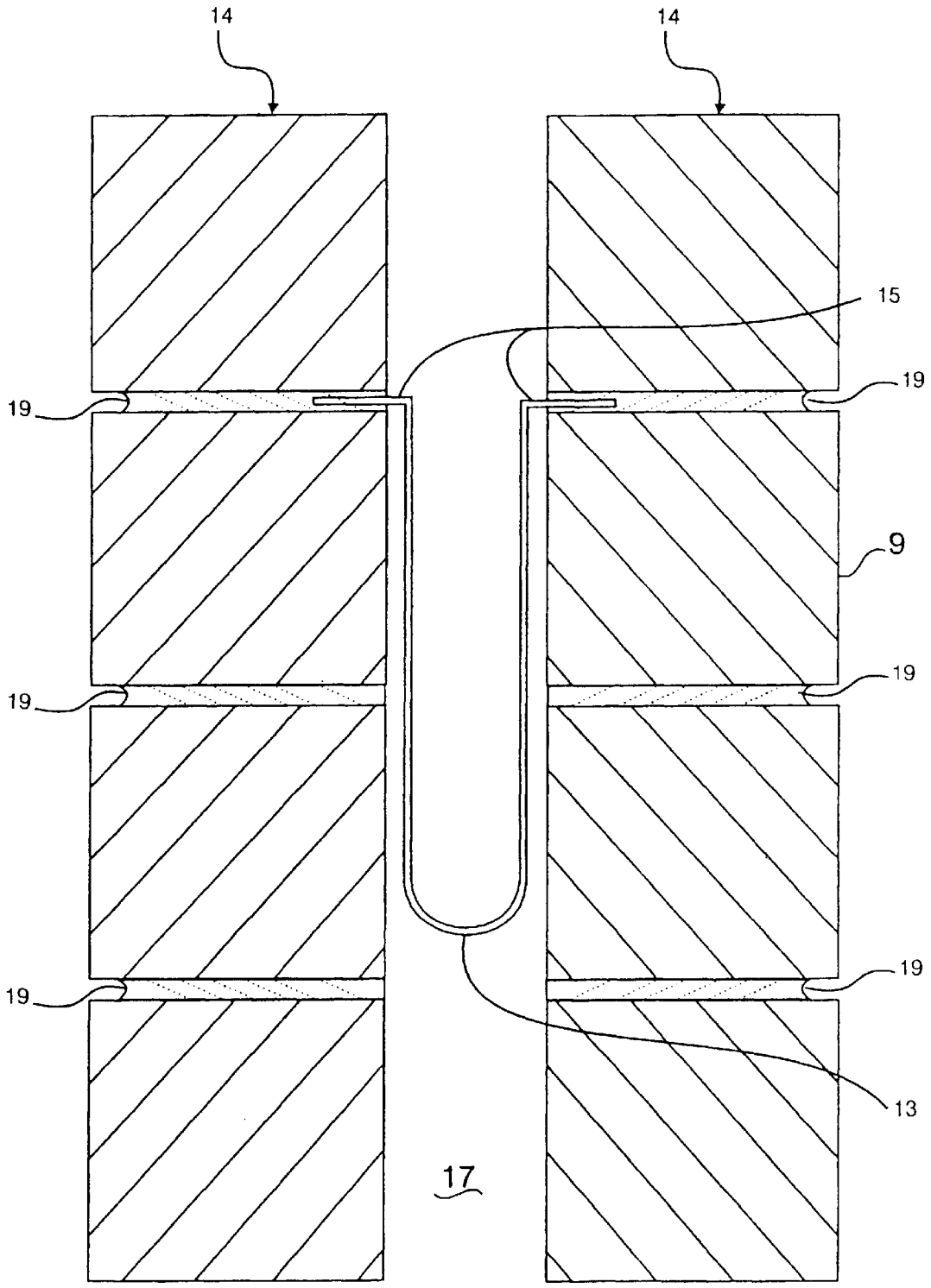
FIG. 2 is a cross sectional view of the elongate member inserted between two leaves of a wall according to the embodiment.
Figure 3:
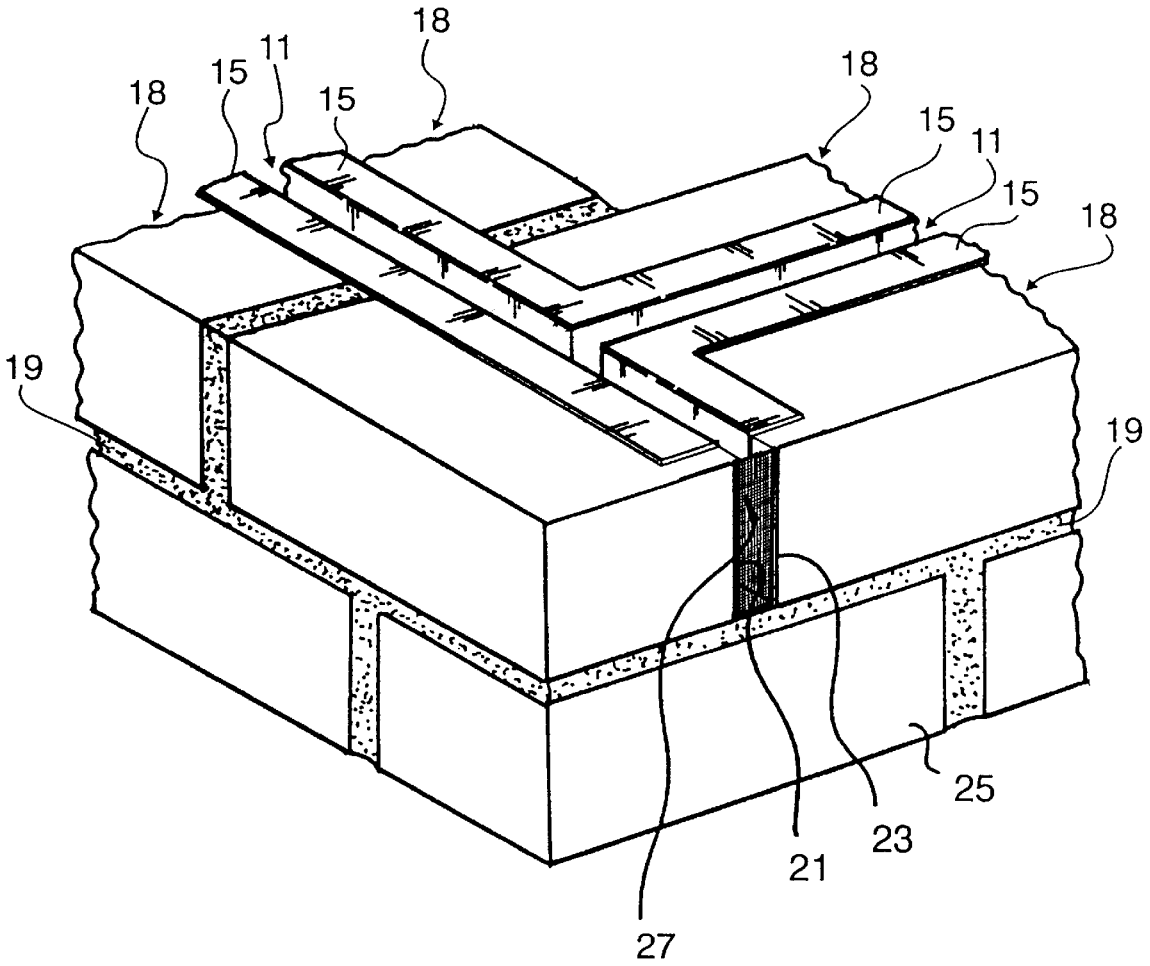
FIG. 3 is a schematic isometric view of a terminating portion of the elongate member extending from a wall according to the embodiment.

The first embodiment of the invention shown at FIGS. 1, 2 and 3 of the accompanying drawings relates to a drainage assembly which is intended for use with double brick walls. The assembly of the first embodiment primarily comprises an elongate member 11 which comprises a central channel portion 13 which is of a generally U-shaped cross section and the upper edges of the channel portion 13 are each provided with a laterally directed lip 15. The channel portion has a width such that in use it will be received within the cavity 17 provided between the leave 18 of a double brick wall as shown at FIG. 2 and the lips 15 are received in the mortar course 19 of the respective leaf of the double brick wall.

The elongate member 11 is formed into discrete lengths. In application of the drainage assembly of the first embodiment and as shown at FIG. 3 it is an object to provide a channel which will span the length of a wall and in order to achieve this, the discrete lengths of the elongate member are cut to length and/or or joined end to end in order that a single channel will extend for the full length of a wall. It is intended that each wall of the building will have its own channel which will extend for the length of the wall except in the case where a doorway or full height window is accommodated in the wall in which case a elongate member will be provided to each side of the doorway or full length window. In locating the elongate member in the wall of a building it is located below the sill-line of the windows in the wall and is preferably located in the lower portion of the wall above the base of the wall.

In addition as shown at FIG. 3 in locating the elongate member in the wall one end 21 is located in the perpendicular space 23 between a pair of bricks in the end wall 25 associated with the wall accommodating the elongate member whereby water collected by the elongate member will be conducted to the exterior of the end wall. If desired an end fitting 27 may be provided to be received in the outer face of the perpendicular space 23 to provide a finished appearance and to prevent the entry of vermin, insects and the like into the cavity through the elongate member. The other end of the elongate member is closed by crimping the end closed or by means of an end cap (not shown) which is sealingly fixed to the other end.

To enhance the drainage of water from the elongate member the elongate member can be mounted in the wall such that it slopes downwardly from the other end to the one end.

During the construction of a building, the elongate member is assembled or formed from one or more lengths of elongate member 11 and is installed in the wall such that the channel portion 13 is received in the cavity and the lips 15 lie on the upper surface of the respective leaf of the wall at that time. In addition the other end of the elongate member is closed by application of an end cap or by crimping. Once the elongate member is in position the wall can be completed. The end fitting can be applied to the one end of the elongate member or to the perpendicular space in the end wall when the laying of the wall has been completed or on installation of the elongate member in position.

In the event that debris or excess mortar becomes deposited in the elongate member during construction such debris may be cleared from the elongate member at the completion of the construction of the wall by flushing the debris out of the elongate member using water or by scraping the debris from the elongate member. In any event, the elongate member portion is formed to have sufficient depth to be able to accommodate some debris and still be able to collect water flowing into the cavity to enable that water to drain from the cavity through the one end of the elongate member. Although this flow may be slowed by the presence of the debris, any water resident in the elongate member in the channel will not be able to soak into the leaves of the wall 19 due to the impervious nature of the elongate member.

In use, the drainage assembly of the first embodiment may be positioned at any desired position along the length of a wall between the upper and lower edges of a wall. In new buildings the drainage arrangement is able to be placed into position during the construction of the wall. In existing buildings, the drainage assembly is positioned at the top of the wall by removing the top plate covering the cavity 17 and inserting the elongate member along the upper extent of the wall.

Figure 4:
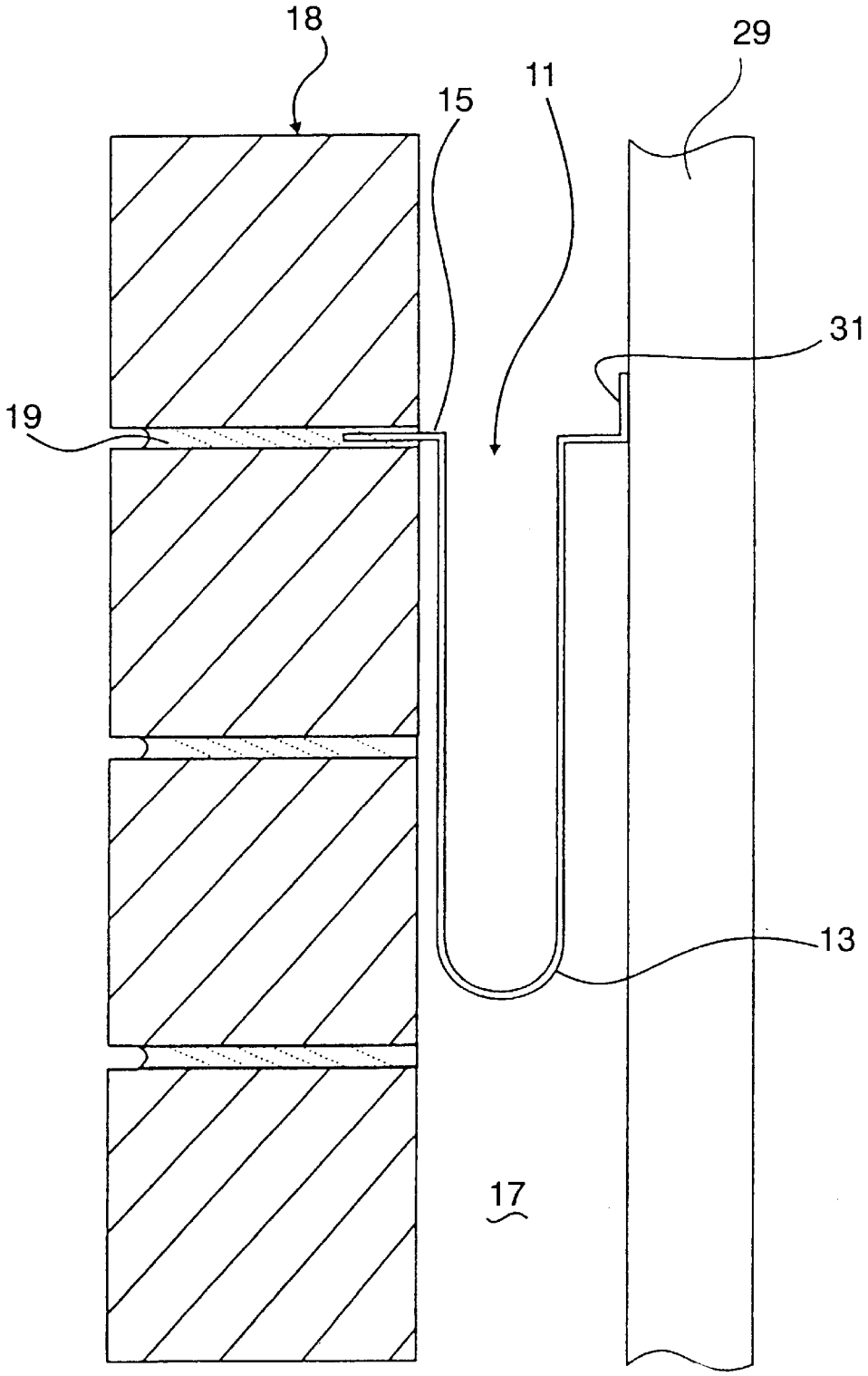
FIG. 4 is a cross sectional view of the elongate member according to a second embodiment accommodated in the cavity of a brick veneer wall.
Figure 5:
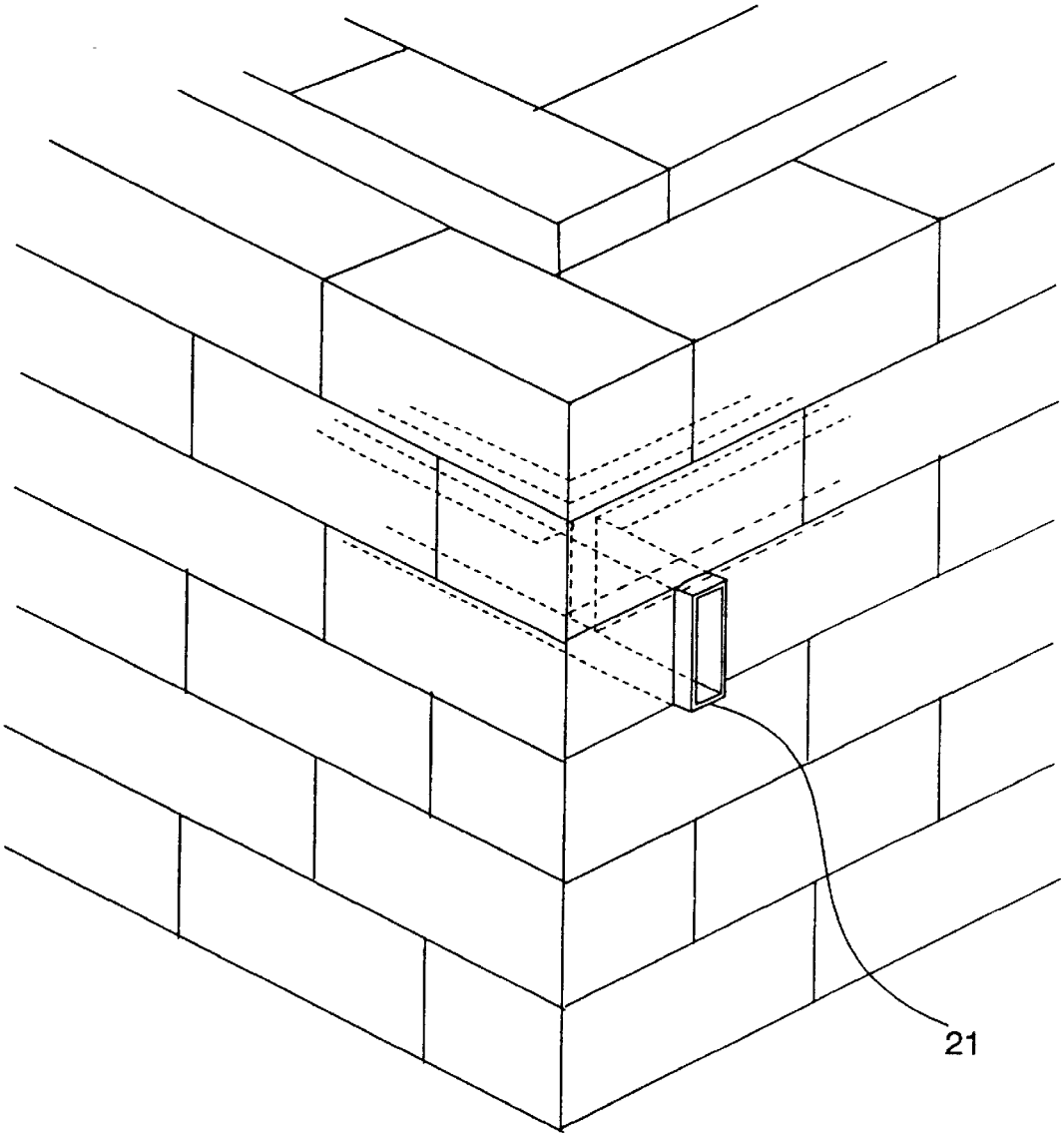
FIG. 5 is an isometric view of a elongate member according to the second embodiment.

The second embodiment of the drainage arrangement as shown at FIGS. 4 and 5 is substantially similar to the first embodiment but is configured for installation between the leaves of a brick veneer wall. In this regard a brick veneer wall comprises a dual leaf wall where one leaf (which is usually outermost) is formed of bricks, blocks or like elements and the other leaf (which is usually innermost) is formed of a frame formed of timber or metal section having a suitable cladding such as plasterboard or GYPROCK applied to its outer face. The frame leaf most usually comprises a plurality of parallel upstanding stud members which are interconnected at their upper and lower ends and by transverse struts intermediate of their length. In this embodiment one lip or a portion of that lip of the elongate member 11 is parallel to the central plane of the channel and forms an upstanding lip 31. The upstanding lip 31 is used for fixing the elongate member 11 to stud members of the inner leaf 29 of a brick veneer wall while the other lip 15 is secured in the mortar course 19 between two courses of bricks of the other leaf 18 of the brick veneer wall as in the first embodiment.

According to a third embodiment of the invention (not shown) the elongate member is adapted to be located in a double leaf wall where the leaves are each formed as framed structures or stud walls.

With each of the above embodiments, the drainage assembly may be positioned at any position between the upper and lower extent of a wall. In new buildings the drainage arrangement may be placed into positions such as below windows, at half height of a wall or near the base of a wall. In existing buildings, the drainage arrangement can be positioned at the top of a wall by removing the top plate covering the cavity 17 and inserting the elongate member at the upper extent of the wall.

According to an alternative embodiment, impervious end members, corner members and joiner members are provided. The end members are used for blocking off the elongate member at positions such as where the wall terminates such as at a door frame. The joiner members facilitate the end to end connection of lengths of the elongate members while the corner members enable the interconnection of elongate members at adjoining walls. In addition, separate outlet members are provided that connect directly to the elongate member, end member, corner member or a joiner member.

In another embodiment the shape of the channel is substantially "V" shaped.

In another embodiment the shape of the base of the channel is substantially flat.

In addition, in the case of each of the embodiments, can be used as an insect barrier to prevent the entry of vermin such as rodents and/or insects such as termites past the barrier and into the building. To facilitate this the elongate member is located at the base of a wall in order that it can also serve as a barrier in that it will prevent any animals or insects which may have entered the base of the cavity from being able to move upwardly through the cavity past the elongate member. In such an instance and as shown at FIG. 3 the end face of the end fitting which is applied to the one end is formed as a grate or of a suitable mesh to prevent the entry of insects into the elongate member through the one end. In addition corner elements are provided which are mounted between the elongate members mounted in adjacent walls at the junctions between the walls in order to connect the adjacent ends of the adjacent elongate members and in order close the spaces between adjacent elongate members provided around the wall of the building and prevent access between the spaces defined above and below the elongate member. In addition in order to isolate the cavity and prevent the entry of animals and/or insects into the cavity a second set of elongate members and corner elements can be mounted at or adjacent the upper edge of the wall.

It should be appreciated that the scope of the present invention need not be limited to the particular scope of the embodiments described above.

Throughout this specification, unless the context requires otherwise, the word "comprise", or variations such as "comprises" or "comprising", will be understood to imply the inclusion of a stated integer or group of integers but not the exclusion of any other integer or group of integers.

What is claimed is:

1. A drainage arrangement in a dual wall having two leaves separated by a cavity, said drainage arrangement comprising one or more imperforate elongate members which form a continues a channel, sides of which are mounted to opposed faces of the leaves of the wall, said one or more elongate members and said channel extending for a full extent of the cavity between the leaves to close a space defined in the cavity below the drainage arrangement, said channel opening into an outlet provided in the wall to allow drainage of water from the elongate member through the outlet.

2. A drainage assembly as claimed at claim 1 wherein the wall comprises a double brick wall.

3. A drainage arrangement as claimed at claim 1 wherein the leaves of the dual wall are formed of bricks.

4. A drainage arrangement as claimed at claim 1 wherein one leaf of the dual wall is formed of bricks and the other leaf is framed.

5. A drainage arrangement as claimed at claim 1 wherein the leaves of the dual wall are both framed leaves.

6. A drainage arrangement as claimed at claim 1 wherein the one or more elongate members comprise a single element cut to a desired length.

7. A drainage arrangement as claimed claim 1 wherein the one or more elongate members comprise a plurality of elements joined end to end to extend a full length of said wall.

8. A drainage arrangement as claimed at claim 1 wherein the outlet comprises an end of the one or more elongate members which is received through a leaf of said dual wall.

9. A drainage arrangement as claimed at claim 1 wherein the one or more elongate members provided in connecting walls are interconnected by corner elements which form an interconnection and which provide a continuation of channels of adjacent elongate members.

10. A drainage arrangement as claimed at claim 9 wherein the elongate members are located at a base of the wall.

11. A drainage arrangement as claimed at claim 10 wherein a second set of elongate members are located adjacent an upper edge of the wall.

12. A drainage arrangement as claimed at claim 1 wherein the elongate members are located adjacent an upper edge of the wall.

13. A drainage arrangement as claimed at claim 1, wherein the elongate members are formed of a plastic material.

14. A drainage arrangement as claimed claim 1, wherein the elongate members are formed of sheet metal.

15. A drainage assembly for use in a dual wall comprising two leaves separated by a cavity, said drainage assembly comprising at least one imperforate elongate member extending along a major axis and having a central portion formed as a channel, a width of the channel being such that the channel can be received between the leaves of the dual wall, at least one end of the channel being open along the major axis such that a plurality of assemblies connected longitudinally along the major axis form a continuous channel along the major axis, upper edges of flanges of the channel each being provided with a laterally extending lip which is intended to be fixed to the respective leaf of said wall whereby the elongate member is adapted to extend for a full extent of the cavity between the leaves, the elongate member having an outlet adapted to extend to an exterior face of the wall to allow drainage of water from the channel.

16. A drainage assembly as claimed at claim 15 wherein the outlet comprises an end of the elongate member adapted to be received in a perpendicular space between adjacent bricks in an end wall of said double brick wall.

17. A drainage assembly as claimed at claim 16, wherein the elongate member is formed of a plastic material.

18. A drainage assembly as claimed at claim 16, wherein the elongate member is formed of sheet metal.

19. A drainage assembly as claimed at claim 1 wherein the elongate member is intended to be located at a base of the wall.

20. A drainage assembly as claimed at claim 19 wherein a second set of elongate members are adapted to be located adjacent an upper edge of the wall and are interconnected to prevent access between a space above the second set of elongate members and a space below the second set of elongate members.

21. A drainage assembly as claimed at claim 18 wherein the second set of elongate members are intended to be located adjacent an upper edge of the wall.

22. A drainage assembly as claimed at claim 15 wherein the elongate members comprise a single element cut to a desired length.

23. A drainage assembly as claimed at claim 15 wherein the elongate members comprise a plurality of elements joined end to end to extend for a full length of a wall.

24. A drainage assembly as claimed at claim 15 wherein the adjacent elongate members provided in connecting walls are interconnected by corner elements which provide a continuation of adjacent elongate members.

25. A drainage assembly as claimed at claim 15 wherein the lips are adapted to be accommodated in a mortar course of a respective leaf of a double brick wall.

* * * * *